United States Patent [19]

Katagiri et al.

[11] Patent Number: 4,966,411

[45] Date of Patent: Oct. 30, 1990

[54] CHAIR PROVIDED WITH A BACKREST

[75] Inventors: Miyoshi Katagiri; Tunetaro Ito; Masamitu Miyashita, all of Nagano; Shinichi Kaneda; Yoichi Suzuki, both of Osaka; Takao Sugano, Osaka, all of Japan

[73] Assignees: Kokuyo Co., Ltd., Osaka; Takano Co., Ltd., Nagano, both of Japan

[21] Appl. No.: 368,348

[22] PCT Filed: Oct. 24, 1987

[86] PCT No.: PCT/JP87/00818

§ 371 Date: May 17, 1989

§ 102(e) Date: May 17, 1989

[87] PCT Pub. No.: WO89/03649

PCT Pub. Date: May 5, 1989

[51] Int. Cl.[5] ..... A47C 3/026

[52] U.S. Cl. ..... 297/301; 297/317; 297/321; 297/322; 297/304

[58] Field of Search ..... 297/300, 301, 316, 317, 297/320, 321, 322, 304, 354

[56] References Cited

U.S. PATENT DOCUMENTS

| | | | |
|---|---|---|---|
| 4,411,469 | 10/1983 | Drabert et al. | 297/321 X |
| 4,684,173 | 8/1987 | Locher | 297/301 X |
| 4,709,962 | 12/1987 | Steinmana | 297/320 |
| 4,761,033 | 8/1988 | Lanuzzi et al. | 297/316 |
| 4,765,679 | 8/1988 | Lanuzzi et al. | 297/316 |

*Primary Examiner*—Peter R. Brown

*Attorney, Agent, or Firm*—Fidelman & Wolffe

[57] ABSTRACT

A chair with a backrest is arranged so that the seat can be shifted forwardly to a rest position upon a rearward inclination of the backrest. The front end of the seat is supported pivotably on a support base, and the seat is movable forwardly and rearwardly. A balancing member is provided below the seat, and the support base supports a fulcrum of the balancing member set between a front and rear point of action of the balancing member. A backrest is provided on the rear end of the balancing member, and a rear part of the seat is supported on the rear point of action of the balancing member through seat receiving means. An upward movement of the front point of action of the balancing member is translated by motion translating means to a forward movement of the seat.

12 Claims, 12 Drawing Sheets

CHAIR PROVIDED WITH A BACKREST

TECHNICAL FIELD

This invention relates to a chair provided with a backrest in which a seat can be shifted forwardly into a rest position by rearward inclination of the backrest.

BACKGROUND ART

In many chairs with a backrest as well as chairs for office work, the backrest can be inclined rearwardly. There is known a chair of this type so constructed that a backrest is mounted inclinably on a support base supporting a seat, with a resiliently urging mechanism resiliently urging the backrest forwardly. There is also known another chair so constructed that a seat and a backrest form an integral body and the front end of the seat is supported inclinably on the front end of a support base, with a resiliently urging mechanism resiliently urging the seat and the backrest in a required direction.

In these chairs, when a rearwardly directed pressure is applied to the backrest, only the backrest or both the backrest and the seat are rearwardly inclined against the urging force of the above-mentioned resiliently urging mechanism, so that the chair can take a rest position.

With this arrangement, however, there is a problem that when the backrest is inclined rearwardly, the center of gravity of the user is greatly shifted rearwardly relative to a support base provided on a leg, so that the user is likely to fall down rearwardly.

On the other hand, there are known chairs in which the seat can be shifted forwardly when the backrest is inclined rearwardly. Among such chairs are chairs used for buses and trains, in which the seat is supported on a support base slidably in forward and rearward directions, and the lower end of the frame of the backrest is mounted pivotally on the rear end of the above-mentioned seat, and the intermediate portion of the backrest frame is mounted on the above-mentioned support base pivotally or both pivotally and slidably up and down.

In this type of chair, when the backrest is inclined, the position of the occupant is not greatly shifted rearwardly. With this arrangement, however, unless the relatively upper portion of the backrest is pushed rearwardly, the backrest cannot be pivoted. This poses a problem that when the user pushes the backrest with his whole back to take a rest position, the movement of his back does not coincide with that of the backrest, so that he feels uncomfortable.

This invention has been proposed in view of these problems encountered in the prior art, and its object is to provide a chair having a backrest, in which the seat is shifted forwardly upon rearward inclination of the backrest, thereby to prevent the chair from falling down rearwardly, and in which the backrest can be inclined rearwardly by pushing any part of the backrest rearwardly without causing uncomfortable feeling to the occupant pushing the backrest.

DISCLOSURE OF THE INVENTION

To attain the above-mentioned object the invention has adopted the following construction.

The chair with a backrest constructed in accordance with the invention is characterized by the provision of a support base, a seat having a front end supported on the support base movably in forward and rearward directions, a balancing member positioned below the seat so as to extend longitudinally and having a fulcrum supported on the above-mentioned support base, a backrest provided on the rear part of the balancing member, seat receiving means for connecting the rear end of the above-mentioned seat to a portion of the above-mentioned balancing member at the rear side of the fulcrum so as to be movable forwardly and rearwardly, and motion translating means for translating an upward movement of the front end of the above-mentioned balancing member to a forward movement of the above-mentioned seat.

With this arrangement, as the user operates to push the backrest with his back rearwardly from a reference position in which the backrest stands upright and the seat is retained at the most retreated position thereof, the balancing member with the backrest is pivoted rearwardly about the fulcrum thereof. As a result, the front point of action of the balancing member is moved upwardly, and this upward movement is transmitted to the above-mentioned seat by the motion translating means, so that the seat is shifted forwardly, with its rear end descending. At this time, because the above-mentioned backrest is pivoted rearwardly on the fulcrum of the balancing member positioned below the above-mentioned seat, the whole backrest is inclined rearwardly and simultaneously shifted rearwardly. Therefore, the movement of the user's back acting on the backrest properly coincides with the movement of the backrest, so that the user never feels uncomfortable. As the backrest is both inclined and shifted rearwardly, the seat advances forwardly, and the center of gravity is not greatly shifted rearwardly. This can eliminate the disadvantage that when a rest position is taken, the chair is likely to fall down rearwardly.

Moreover, since the rear end of the seat is supported on the rear point of action of the balancing member through the seat receiving means, the rearward pivotal movement of the balancing member can effectively be used to effect a descending motion of the rear end of the seat, so that there is no need for using complex mechanisms to effect the descending motion of the seat.

If the chair is so constructed that the rear end of the seat may descend relative to the front end thereof upon forward movement of the seat caused by rearward inclination of the backrest and the upward movement of the front end of the balancing member, it is possible to eliminate the feeling of forward sliding the user would otherwise have when he is taking a rest position.

In accordance with the invention, the chair with a backrest having the above-mentioned basic arrangement is provided with a resiliently urging mechanism for resiliently urging the seat rearwardly.

With this arrangement, when the backrest is inclined rearwardly and the seat is moved forwardly from the above-mentioned reference position, the urging force applied by the above-mentioned resiliently urging mechanism functions as a resistive force against the movement of the seat. Therefore, the user must push the backrest rearwardly against the resilient repellent force in order to take a rest position. When the user raises the upper half of his body or leaves the chair, the seat is returned to its most retreated position by the urging force of the above-mentioned resiliently urging mechanism, and at the same time the balancing member is pivoted forwardly and the backrest stands upright, so that the whole chair is returned to its reference position by itself.

The invention employs as the seat receiving means the means which can produce a force for pulling the above-mentioned seat rearwardly by utilizing a force downwardly acting on the seat.

With this arrangement, the following operations and effects are added to the chair. With the seat receiving means of this construction, a rearward pulling force corresponding to the weight of the user seated in the chair acts on the seat. The pulling force acts on the front point of action of the above-mentioned balancing member as a downwardly directed force through the motion translating mechanism. On the other hand, a downwardly directed force corresponding to the weight of the user acts on the rear point of action of the balancing member. Therefore, only if the position of the fulcrum and the dimension of each component part are preset so that a downwardly directed force, which varies with the user's weight, remains on the front point of action even after the above-mentioned downwardly directed force acting on the front point of action has been offset by the above-mentioned downwardly directed force acting on the rear point of action, the above-mentioned balancing member is likely to be pivoted forwardly by a force corresponding to the weight. Therefore, the user of a heavy weight must exert a large force to incline the backrest rearwardly, while a smaller force suffices with the user of a light weight. The backrest is inclined rearwardly by directly pushing it with one's back. Since a person of a heavy weight usually provides by his back a larger operating force on the backrest than a person of a light weight, it is preferable to have the force for operating the backrest variable in the above-mentioned manner.

The invention further includes the following concrete arrangements. The seat receiving means may be provided with link members each having a lower end pivotally connected to the above-mentioned balancing member and an upper end pivotally connected to the above-mentioned seat, and so arranged that at the reference position where the seat is maintained at its most retreated position, the upper pivot end of each link member is positioned rearwardly of the lower pivot end thereof.

With this arrangement, the above-mentioned operation, wherein at an initial stage the backrest begins to incline from the above-mentioned reference position, and a person having a greater weight must exert a larger force for operating the backrest by his back, can be effected by a simple construction with a few component parts.

The improved chair with a backrest of the invention is provided with a locking mechanism for stopping the movement of the above-mentioned seat and backrest at a desired position.

With this arrangement, the backrest and the seat can be locked simultaneously at any desired position by a proper operation by the user, so that the user may relax himself and take a comfortable rest position on the chair.

DESCRIPTION OF THE PREFERRED EMBODIMENTS

Referring now to FIGS. 1 through 9, one embodiment of the invention will be described below.

Figure 1:
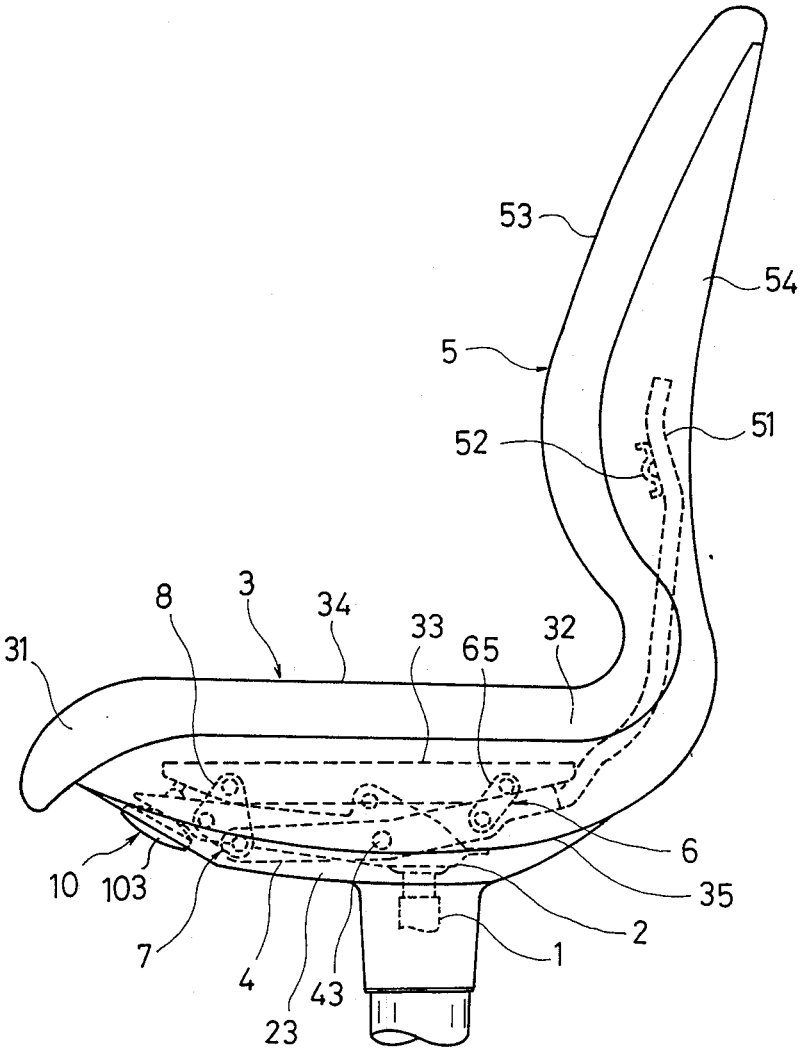
FIG. 1 is a side view of one embodiment of the invention, with part thereof being omitted.
Figure 2:
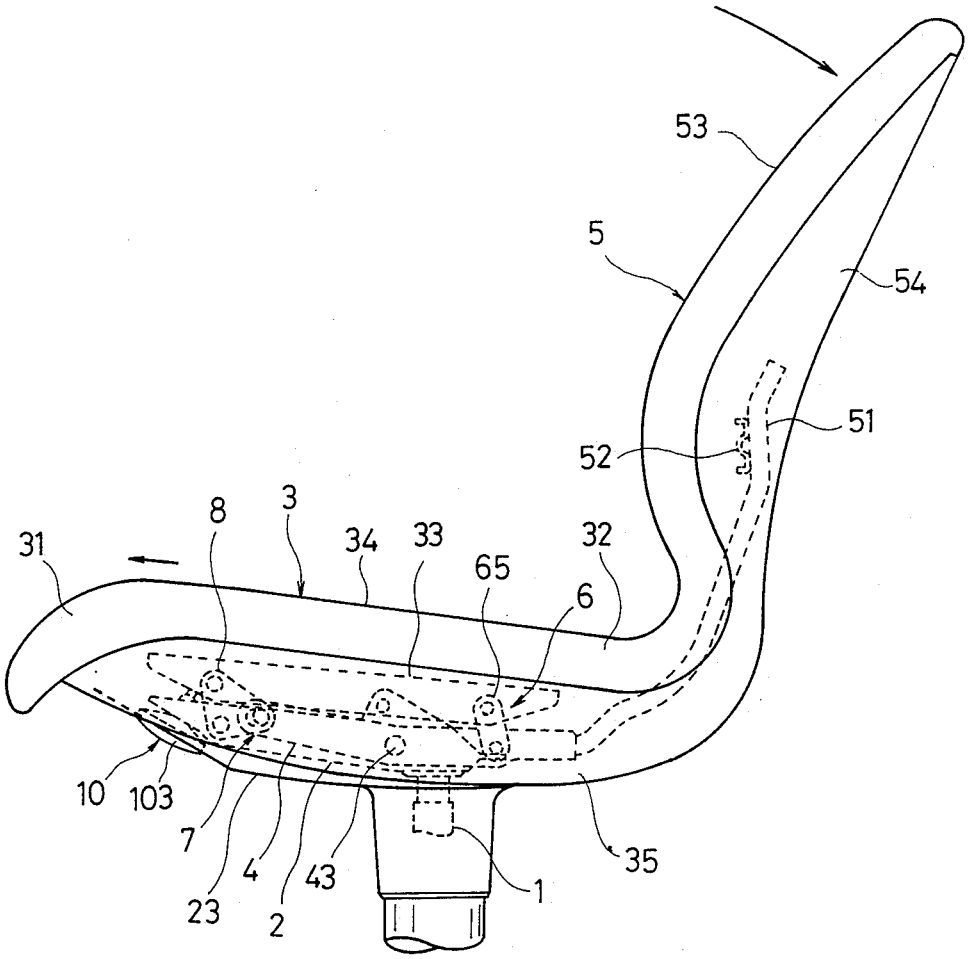
FIG. 2 is a side view of the same embodiment with the backrest at an inclined position.

As shown in FIGS. 1 and 2, the chair with a backrest comprises a support base 2 mounted on a leg 1, a seat 3 having a front end 31 supported on the support base 2 so as to be movable forwardly and rearwardly, a balancing member 4 positioned below the seat 3 so as to extend lengthwise thereof and having a fulcrum 43 supported on the above-mentioned support base 2 between a rear and a front point of action 41 and 42, a backrest 5 provided on the rear end 44 of the balancing member 4, seat receiving means 6 for connecting the rear end 32 of the above-mentioned seat 3 to the above-mentioned rear point of action 41 of the above-mentioned balancing member 4 so as to be movable forwardly and rearwardly, and motion translating means 7 for translating an upward movement of the above-mentioned front point of action 42 of the above-mentioned balancing member 4 to a forward movement of the above-mentioned front point of action 42 of the above-mentioned seat 3.

Figure 3:
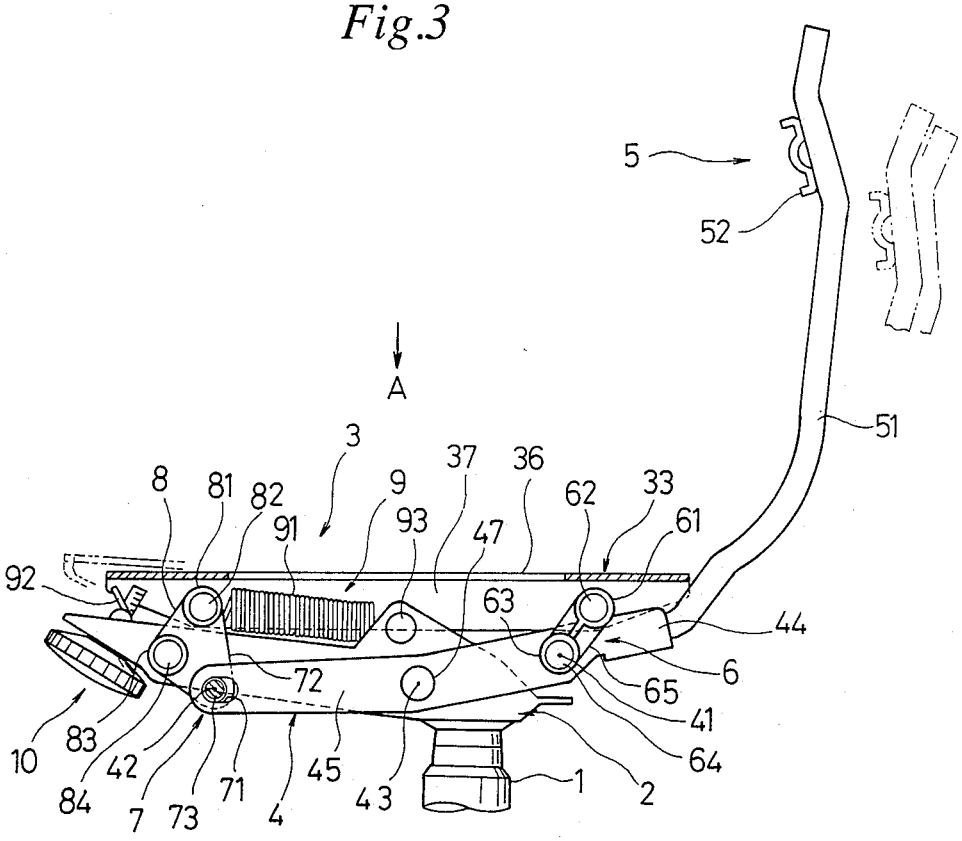
FIG. 3 is a side view of the main portion of the same embodiment.
Figure 4:
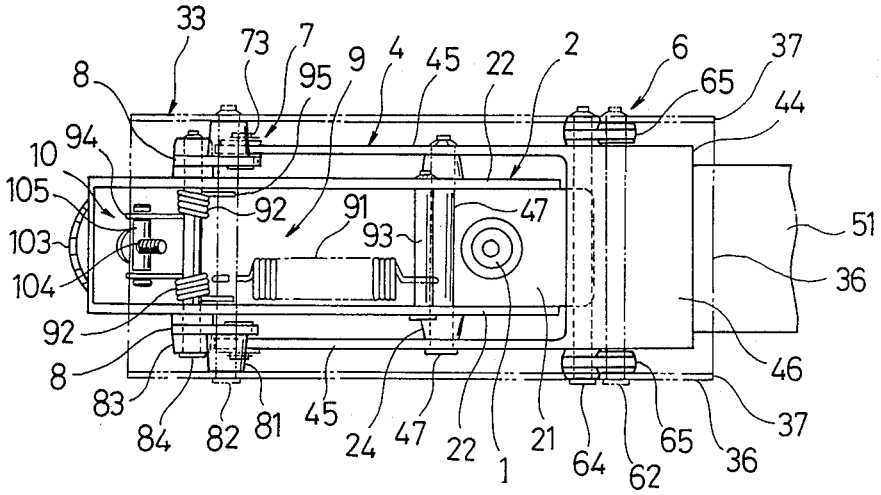
FIG. 4 is a view as viewed in the direction of the arrow A in FIG. 3.
Figure 5:
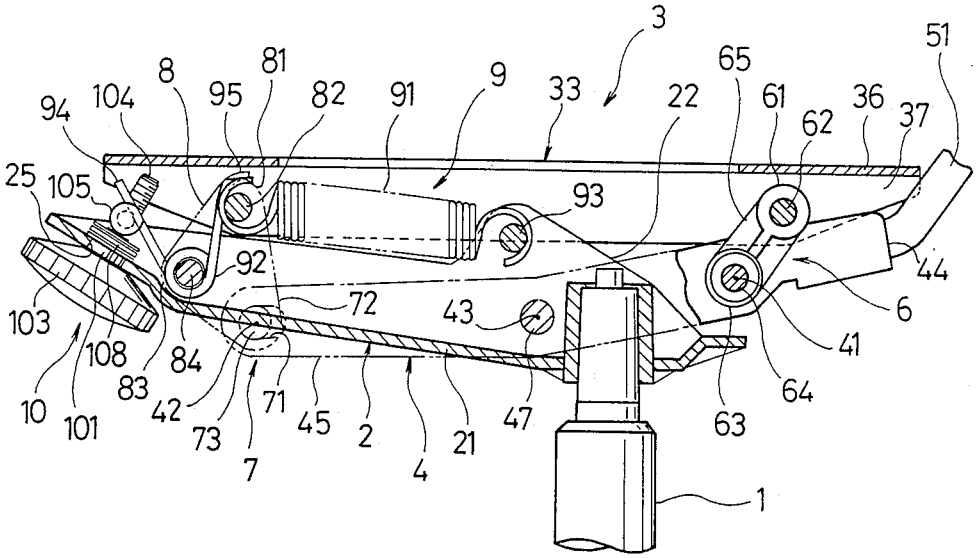
FIG. 5 is an enlarged side view of the main portion of the same embodiment.

As shown in FIGS. 3 through 5, the support base 2 is a channel member comprising a bottom plate 21 fixed to the upper end of the above-mentioned leg 1 and a pair of side plates 22 standing integrally on the opposite lateral edges of the bottom plate 21. The front end 31 of the above-mentioned seat 3 is supported on the side plates 22 close to the front ends thereof by a pair of front link members 8. A seat receiving cover 23 is provided on the bottom of the support base 2.

As shown in FIG. 1, the seat 3 is composed of an inner shell not shown but mounted on a receiving frame 33, a cushion not shown but disposed on the inner shell, and a surface finishing material 34 covering the outer surface of the cushion. The under surface of the above-mentioned inner shell is covered with an outer shell 35.

Figure 7:
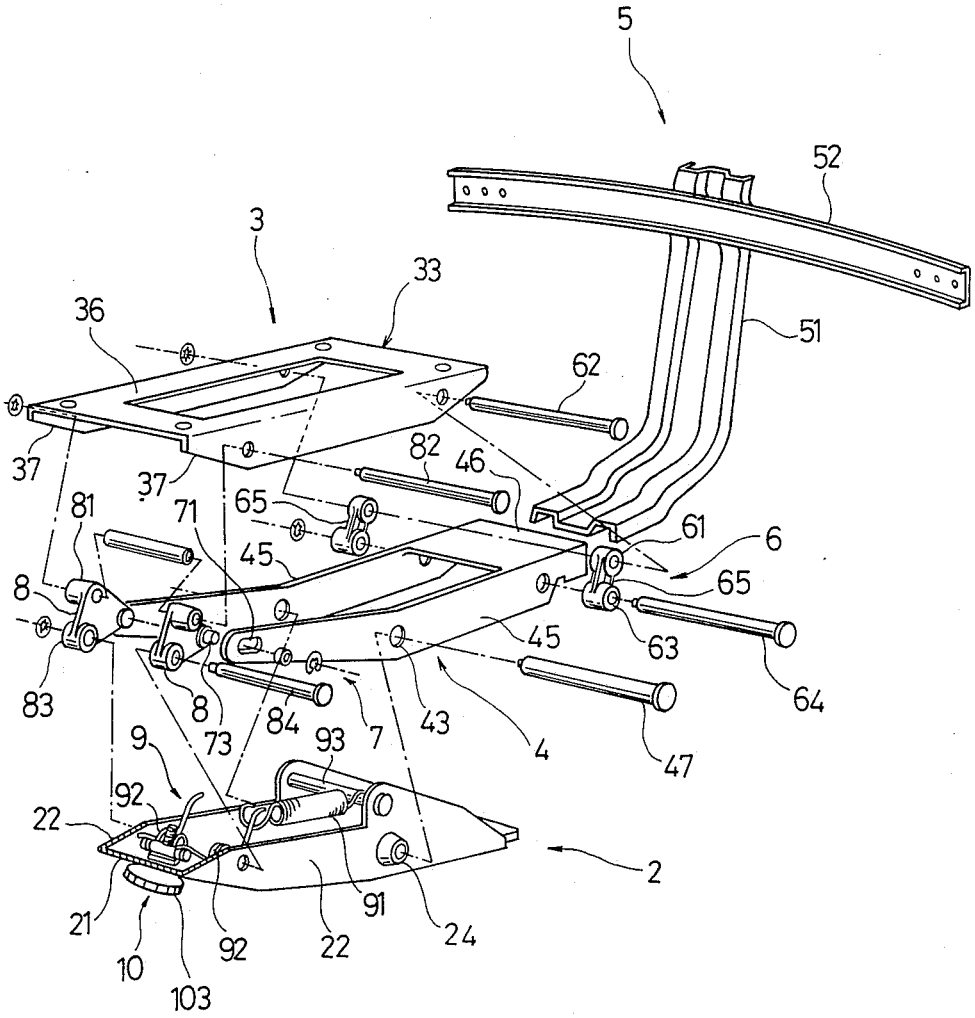
FIG. 7 is a perspective view of the main portion, as shown disassembled.

The central portion of the outer shell 35 has an opening to prevent interference with the above-mentioned seat receiving cover 23. As shown in FIGS. 3, 5 and 7, the above-mentioned receiving frame 33 is provided with a top plate 36 for supporting the above-mentioned inner shell, and a pair of side plates 37 depending integrally from the opposite lateral edges of the top plate 36. The upper pivot ends 81 of the above-mentioned front link members 8 are pivoted by a shaft 82 to the side plates 37 close to their front ends, and the lower pivot ends 83 of the front link members 8 are pivoted by a shaft 84 on the side plate 22 of the above-mentioned support base 2. At the reference position where the seat 3 is retained at the most retreated position (refer to the real lines in FIGS. 1 and 3), the upper pivot ends 81 of the above-mentioned front link members 8 are so arranged as to be positioned rearwardly of the lower pivot ends 83 thereof.

As shown in FIGS. 3, 4 and 7, the balancing member 4 comprises a pair of parallel plates 45 extending lengthwise and a connecting plate 46 integrally connecting the rear end portions of the parallel plates 45. The fulcrum 43 provided at the middle point of the above-mentioned parallel plates 45 is pivotally supported by a shaft 47 on bosses 24 provided on the side plates 22 of the above-mentioned support base 2. The backrest 5 is connected to the rear end 44 of the balancing member 4.

As shown in FIG. 1, the backrest 5 comprises a frame 51 secured to the rear end of the above-mentioned balancing member 4, an inner shell not shown but secured to the frame 51 by a channel member 52, a cushion not shown but attached to the front surface of the inner shell and a surface finishing material 53 covering the outer surface of the cushion. An outer shell 54 covers the above-mentioned inner shell, the above-mentioned frame 51 and the channel member 52 at the rear surfaces thereof. The inner shell, the cushion, the surface finishing material 53 and the outer shell 54 of the backrest 5 of this embodiment are made integral with the inner shell, the cushion, the surface finishing material 34 and the outer shell 35 of the above-mentioned seat 3, respectively. However, they may be made separate from each other.

The seat receiving means 6 is so constructed as to utilize the downwardly directed force acting on the above-mentioned seat 3 to produce a force pulling the seat 3 rearwardly. In particular, as shown in FIGS. 3 through 5, the above-mentioned seat receiving means 6 is provided with a pair of rear link members 65 each having an upper pivot end 61 pivoted by a shaft 62 to the above-mentioned receiving frame 33 and a lower pivot end 63 pivoted by a shaft 64 to the above-mentioned balancing member 4. At the reference position where the above-mentioned seat 3 is retained at the most retreated position, the upper pivot ends 61 of the above-mentioned link members 65 are positioned rearwardly of the lower pivot ends 63 thereof.

As shown in FIGS. 3 through 5 and FIG. 7, the motion translating means 7 comprises a slot 71 formed in the above-mentioned balancing member 4 close to each front point of action 42 thereof so as to extend lengthwise, an arm 72 integral with and projecting from each front link member 8, and a connecting pin 73 projecting from each arm 72 so as to slidably engage the slot 71. The line extending from the axis of the above-mentioned lower pivot end 83 of each front link member 8 to the axis of the upper pivot end 81 thereof is so arranged as to cross the line extending from the axis of the lower pivot end 83 to the axis of the above-mentioned connecting pin 73 at approximately right angles therewith.

Figure 6:
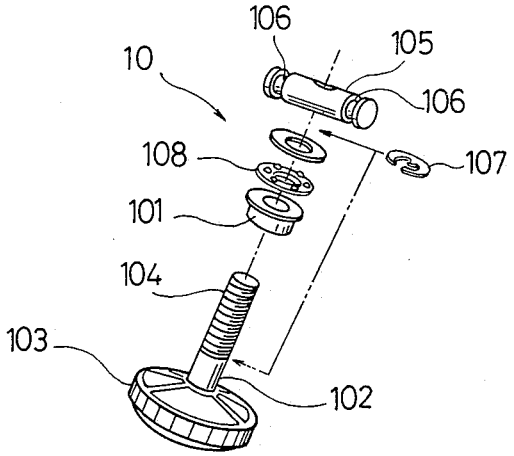
FIG. 6 is a perspective view of a portion of the resiliently urging means, as shown disassembled.

In the above-mentioned chair there is also provided resiliently urging means 9 between the above-mentioned support base 2 and the above-mentioned seat 3. The resiliently urging means 9 comprises a main spring 91 and a pair of subsidiary springs 92. The main spring 91 is a tension coil spring extending between the above-mentioned shaft 82 supported by the receiving frame 33 of the above-mentioned seat 3 and a cross bar 93 supported by the rear portion of the above-mentioned support base 2. Each subsidiary spring 92 comprises a helical torsion spring wound around the above-mentioned shaft 84 supported on the above-mentioned support base 2. The front end 94 of each subsidiary spring 92 is engaged by the above-mentioned support base 2 through a spring-force regulating mechanism 10 while the rear end 95 thereof is resiliently engaged by the above-mentioned shaft 82. As shown in FIGS. 5 and 6, the spring-force regulating mechanism 10 comprises a flanged bearing sleeve 101 fitted in a hole 25 formed in the front end portion of the bottom plate 21 of the above-mentioned support base 2, a control grip 103 having a stem 102 rotatably inserted through the bearing sleeve 101, a feed screw 104 integral with the stem 102 of the control grip 103, and a retainer 105 fitted to the screw 104. The retainer 105, for example, can be a shaft-like member crossing the above-mentioned screw 104 at right angles therewith, and provided near the opposite ends thereof with a pair of annular recesses 106 which the front ends 94 of the subsidiary springs 92 engage. A retainer ring 107 is provided about the stem 102 of the above-mentioned control grip 103 so as to be supported on the flange of the above-mentioned bearing sleeve 101 via a thrust bearing 108.

The operation of the chair will now be described.

In the reference position shown in real lines in FIGS. 1 and 3, the backrest 5 stands upright, and the seat 3 is kept at the most retreated position thereof. This reference position is set to the most suitable one for office work. As the user pushes with his back the above-mentioned backrest 5 rearwardly from the reference position, the balancing member 4 together with the backrest 5 is pivoted rearwardly about the fulcrum 43. As a result, the front point of action 42 of the balancing member 4 is upwardly moved and the upward movement is transmitted to the above-mentioned seat 3, which moves forwardly with the rear end 32 thereof descending. In particular, as the front point of action 42 of the above-mentioned balancing member 4 is moved upwardly, each front link member 8 connected to the front point of action 42 by the connecting pin 73 of the arm 72 is forwardly pivoted about the lower pivot end 83 so that the upper pivot end 81 shifts the seat 3 forwardly. At the same time each rear link member 65 is also pivoted forwardly about the lower pivot end 63, which is supported on the rear point of action 41 of the above-mentioned balancing member 4. Therefore, provided that the dimensions of the component parts are so predetermined, as in the present embodiment, that the degree of downward movement of each rear link member 65 as a whole caused by the pivotal movement of the above-mentioned balancing member 4 is greater than that of upward movement of the upper pivot end 61 of each rear link member 65 caused by the pivotal movement of the rear link member 65, the above-mentioned seat 3 is caused to advance while descending at the rear end 32 thereof. As a result, the chair can be shifted to a rest position (as shown in dot-and-dash lines in FIGS. 2 and 3 and FIG. 9) without giving the user a feeling of slipping forwardly. Moreover, with this arrangement, by making the best use of the rearward pivotal movement of the balancing member 4 it is possible to make the rear end 32 of the above-mentioned seat 3 descend without the necessity of using any complex mechanism for descending motion. Therefore, it is easy to manufacture the chair.

As mentioned above, as the seat 3 advances, the above-mentioned backrest 5 is pivoted rearwardly about the fulcrum 43 of the balancing member 4 disposed below the seat 3, so that the whole backrest 5 is shifted rearwardly while being inclined rearwardly. Therefore, the motion of the user's back acting on the backrest 5 properly coincides with the movement of the chair back 5, so that the user does not feel uncomfortable. When the backrest 5 is shifted rearwardly while being inclined rearwardly, the seat 3 advances, so that it is possible to prevent occurrence of a troublesome condition that the center of gravity of the user is shifted rearwardly thereby to cause the chair to fall down rearwardly.

The chair is provided with resiliently urging means 9 for resiliently urging the above-mentioned seat 3 rearwardly. With this arrangement, when the backrest 5 is inclined rearwardly from the above-mentioned reference position thereby to advance the seat 3, the urging force of the above-mentioned resiliently urging means 9 counteracts the movement thereof. Therefore, the user pushes the backrest 5 rearwardly against the resilient force so as to take a rest position. Then, when the above-mentioned user raises the upper half of his body on the chair or leaves the chair, the above-mentioned seat 3 is returned to its most retreated position by the resilient force of the above-mentioned resiliently urging means 9, and the balancing member 4 is shifted forwardly, and the backrest 5 stands upright, so that the whole chair is returned to its reference position by itself. In this reference position, since the frame 51 of the backrest 5 abuts on and is retained by a stopper not shown, the backrest 5 is not pivoted further forwardly.

Moreover, with the above-mentioned arrangement of the seat receiving means 6, a backward pulling force corresponding to the weight of the user seated in the chair acts on the seat 3. In particular, when the chair is positioned at the reference position close thereto, the rear link members 65 constituting the seat receiving means 6 are inclined rearwardly. Under the condition, if a downward force corresponding to the weight of the user acts on the upper pivot ends 61 of the rear link members 65 through the seat 3, the rear link members 65 are shifted rearwardly. As a result, a rearward pulling force is applied to the receiving frame 33 of the seat 3 connected to the upper pivot ends 61 of the rear link members 65. This pulling force acts as a downward force on the front point of action 42 of the above-mentioned balancing member 4 through the motion translating means 7. In particular, as the above-mentioned receiving frame 33 is pulled rearwardly, a force acting on the front link members 8 to cause them to pivot rearwardly is applied to the front link members 8 having their upper pivot ends 81 connected to the receiving frame 33. As a result, the arm 72 provided on each front link member 8 is pivoted downwardly, and the connecting pin 73 projecting from each arm 72 pushes the front point of action 42 of the above-mentioned balancing member 4 downwardly. An additional downward force caused by the weight of the user acts on the upper pivot ends 81 of the front link members 8 through the seat 3. This downward force also acts as a force to pivot the front link members 8 rearwardly, and functions as a force to push the front point of action 42 of the above-mentioned balancing member 4 downwardly through the above-mentioned connecting pins 73. Thus, a downward force increasing or decreasing depending upon the weight of the user (which force will be referred to as "the weight-depending front force" for abbreviation hereinafter) is applied to the front point of action 42 of the above-mentioned balancing member 4. On the other hand, a downward force increasing or decreasing depending upon the weight of the user (which force will be referred to as "the weight-depending rear force" for abbreviation hereinafter) is applied to the rear point of action 41 of the balancing member 4 through the rear link members 65. In this embodiment, the arrangement is such that the weight-depending rear force acting on the rear point of action 41 cannot offset the weight-depending front force acting on the front point of action 42. In other words, the position of the fulcrum 43 and the dimensions of the component members are preset so that the previously mentioned downward force increasing or decreasing depending upon the weight of the user remains on the front point of action 42. As a result, the above-mentioned balancing member 4 and backrest 5 are pivoted forwardly by a force corresponding to the weight. Therefore, a user of a heavy weight must exert a large force to incline the backrest rearwardly, while a user of a light weight needs only a smaller force.

The backrest 5 is inclined rearwardly by a user directly pushing it with his back. Usually, a person of a heavy weight has a larger force than a person of a light weight to push the backrest with his back. Therefore, it is preferable that the force for operating the backrest should vary in the above-mentioned manner. If chairs for use in meeting rooms or with office automation equipment, that is, chairs to be used commonly by persons of different physiques have such functions as mentioned above, the initial repellent strength of the backrest 5 need not be adjusted to different users, so that the chair can be used conveniently.

Figure 8:
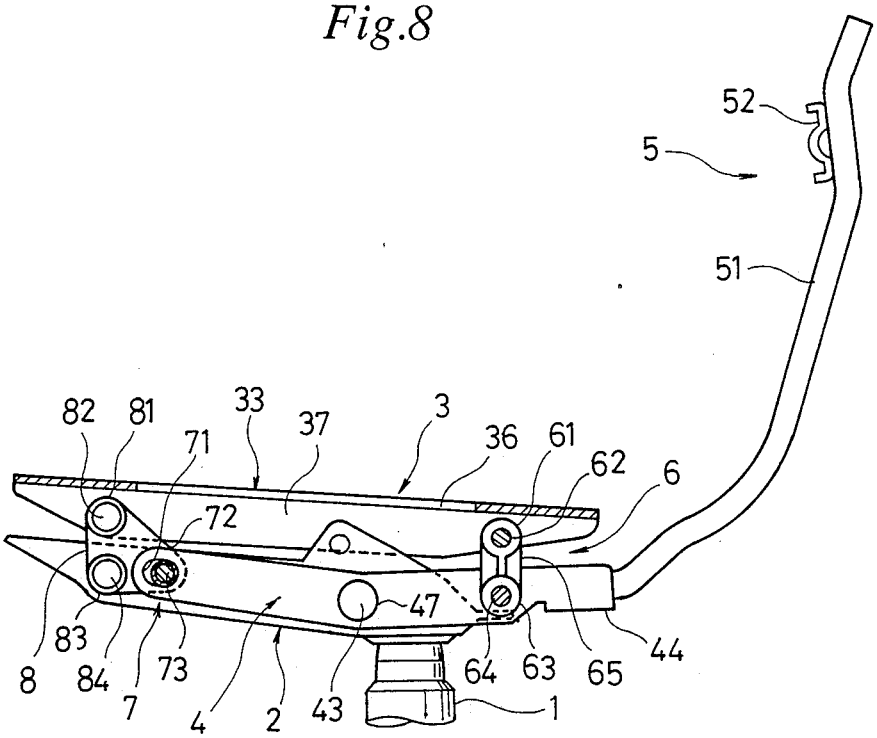
FIGS. 8 and 9 are side views of the same embodiment corresponding to FIG. 3 for explanation of the operation of the same embodiment.
Figure 9:
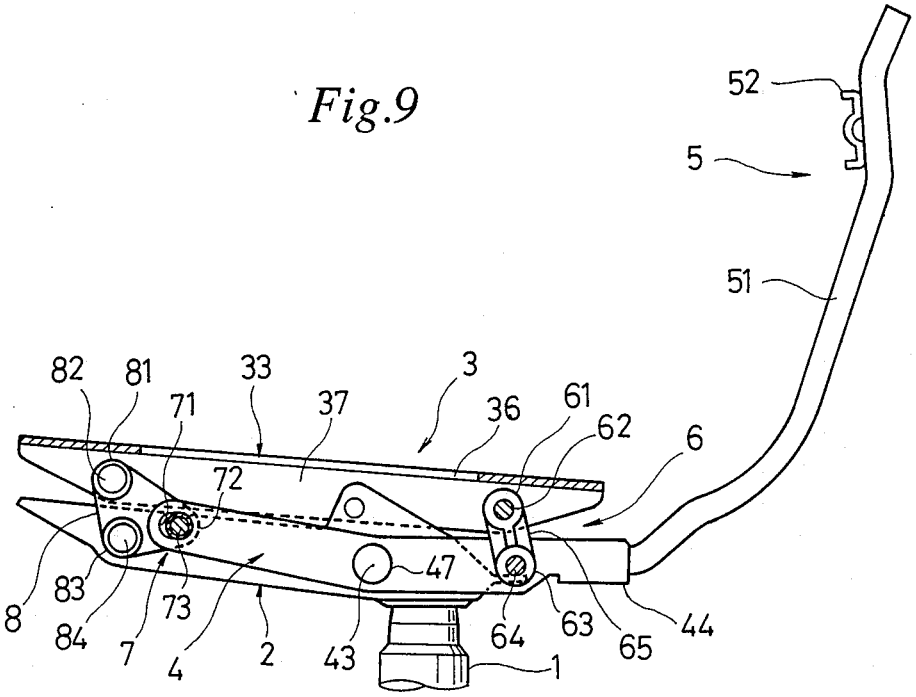

The above-mentioned operation is conducted at the initial stage where the backrest 5 begins to be inclined rearwardly from the above-mentioned reference position. In particular, as the rearward inclination of the backrest 5 increases so that the front link members rise upright, the above-mentioned weight-depending front force acting on the front point of action 42 of the balancing member 4 gradually decreases. On the other hand, the above-mentioned weight-depending rear force acting on the rear point of action 41 of the balancing member 4 does not greatly change in spite of the change in inclination of the front link members 8. Therefore, the priority of the weight-depending front force disappears well before the link members 8 and 65 stand upright as shown in FIG. 8, so that the repellent force of the backrest 5 no longer increases or decreases depending upon the weight of the user.

As described above, the above-mentioned seat 3 is resiliently urged rearwardly by the main spring 91 and the subsidiary springs 92. Therefore, this resilient urging force function as a downward force (which will be referred to as "the spring-depending force" for abbreviation hereinafter) on the front point of action 42 of the above-mentioned balancing member 4 through the the front link members 8. The spring-depending force increases as the seat 3 advances to increase the amount of resilient deformation of the springs 91 and 92. After the above-mentioned backrest 5 has been greatly inclined rearwardly, so that the weight-depending force to urge the backrest 5 forwardly has lost its effect, the spring-depending force only urges the backrest 5 forwardly. The spring-depending force is produced by the pulling force of the main spring 91 and the pressing force of the subsidiary springs 92. Therefore, by adjusting the spring force of the above-mentioned subsidiary springs 92 it is possible to change the spring-depending force thereby to change the magnitude of the force to urge the backrest 5 forwardly. If a single spring corresponding to the above-mentioned main spring 91 was provided to urge the seat 3 rearwardly, a complicated mechanism would be required to adjust the spring force from outside. On the contrary, since the chair of the invention is so arranged that the seat 3 is urged rearwardly by the main spring 91 and the subsidiary springs 92, and the subsidiary springs 92 are provided at the forward end of the support base 2, it is possible to adjust the spring force of the springs from outside by using the above-mentioned simple spring-adjusting mechanism 10. With this arrangement, it is also possible to arrange so that at the initial stage of inclination of the backrest 5 the subsidiary springs 92 do not work, and that when the weight-depending force has stopped urging the backrest 5 forwardly, the subsidiary springs 92 become active.

In the above-mentioned embodiment, the main spring is of such a type that the spring force increases linearly as it expands. The spring may also be of such a type that as the spring expands, the spring force increases curvilinearly with its rate of change increasing. As an example of the spring having such a characteristic there is available a coil spring which has a high coil density in the opposite ends and a low coil density in the middle thereof.

Figure 10:
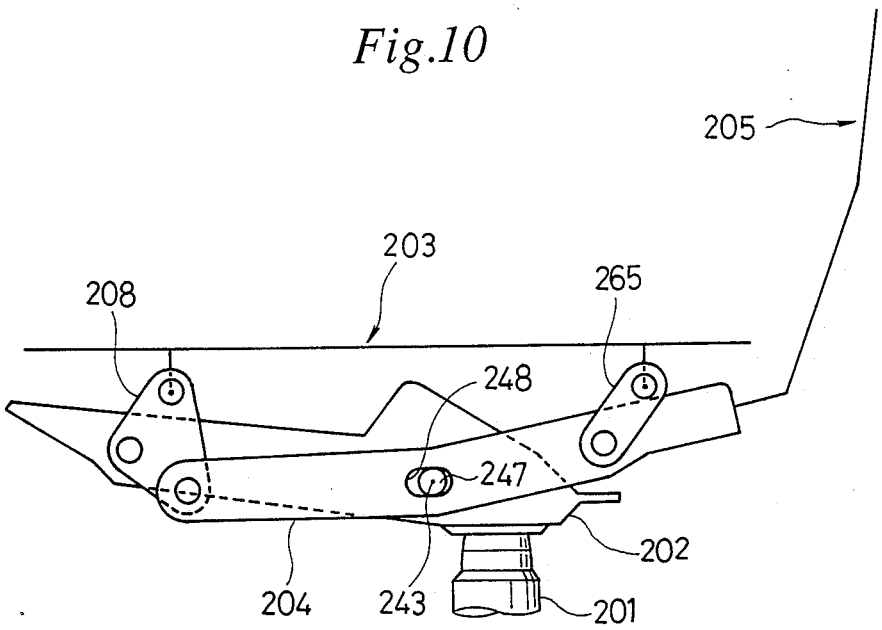
FIGS. 10 and 11 are schematic side views of different embodiments, respectively, wherein the balancing member has different supporting structures.
Figure 11:
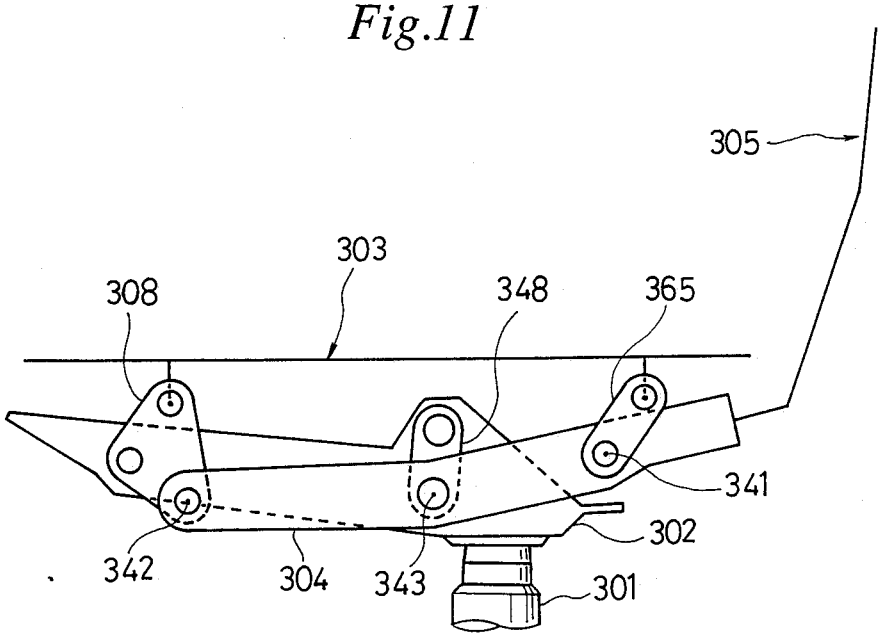

Examples of the mode of supporting the balancing member are shown in FIGS. 10 and 11.

The balancing member 204 shown in FIG. 10 has a pair of slots 248 in its fulcrum 243. The balancing member 204 is swingably supported by a shaft 247 fixed to the support base 202 and engaging the slot 248. In this case, a pivoting mechanism can be provided in not only the connection between each rear link member 265 and the balancing member 204 but also the connection between each front link member 208 and the balancing member 204. In FIG. 10, 201 is a leg, 203 is a seat, and 205 is a backrest.

The balancing member 304 shown in FIG. 11 has its fulcrum 343 pivoted to the lower end of a pair of central link members 348. The upper end of each central link member 348 is pivoted to the support base 302. With this arrangement, it is possible to provide a pivoting mechanism in all of the fulcrum 343 of the balancing member 304, the connection between each rear link member 365 and the rear point of action 341, and the connection between each front link member 308 and the front point of action 342. Because the pivoting mechanism always makes it possible to have the outer surface of the pivot shaft in contact with or close to the inner surface of the hole for receiving the shaft, it can effectively prevent foreign bodies from entering between the surfaces thereby to avoid or suppress increase of the sliding resistance therebetween and production of screeching sounds for a long time. Since chairs are usually used for a long period of time without particular maintenance work, it is advantageous that all connecting portions of movable parts include a pivoting mechanism. In FIG. 11, 301 is a leg, 303 is a seat, and 305 is a backrest.

Besides the motion translating means described above, those shown, for example, in FIGS. 12 through 14 can also be used.

Figure 12:
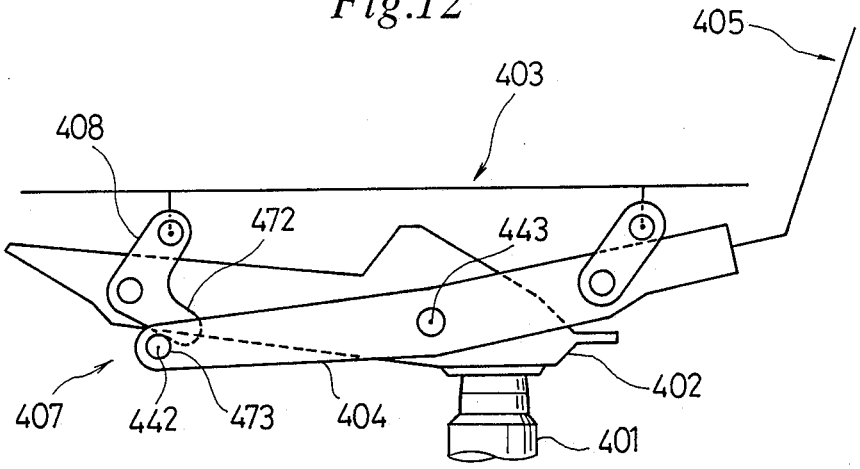
FIGS. 12, 13 and 14 are schematic side views of different embodiments, respectively, with different forms of the motion translating means.

In the motion translating means 407 shown in FIG. 12, a pin 473 is fixed to the front point of action 442 of the balancing member 404, and the pin 473 is in sliding contact with the lower edge of the arm 472 of each front link member 408. In FIG. 12, 401 is a leg, 402 is a support base, 403 is a seat, 405 is a backrest, and 443 is a fulcrum.

Figure 13:
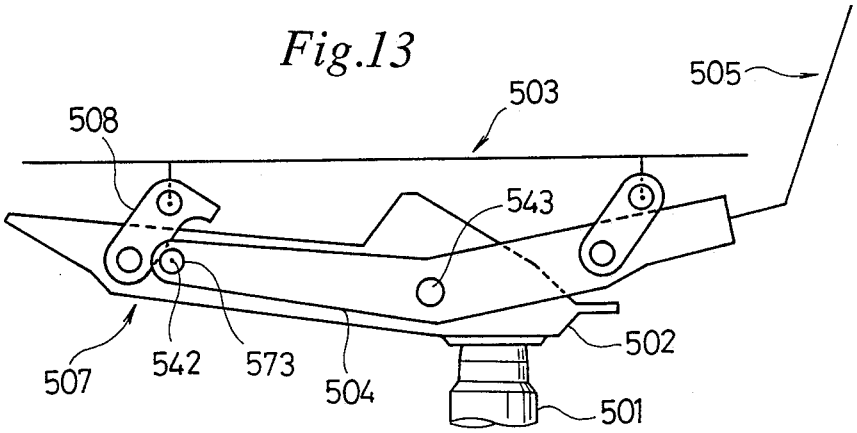

In the motion translating means 507 shown in FIG. 13 a pin 573 is fixed to the front point of action 542 of the balancing member 504, and the pin 573 is in sliding contact with the rear edge of each front link member 508 inclined rearwardly. In FIG. 13, 501 is a leg, 502 is a seat, 505 is a backrest, and 543 is a fulcrum.

Figure 14:
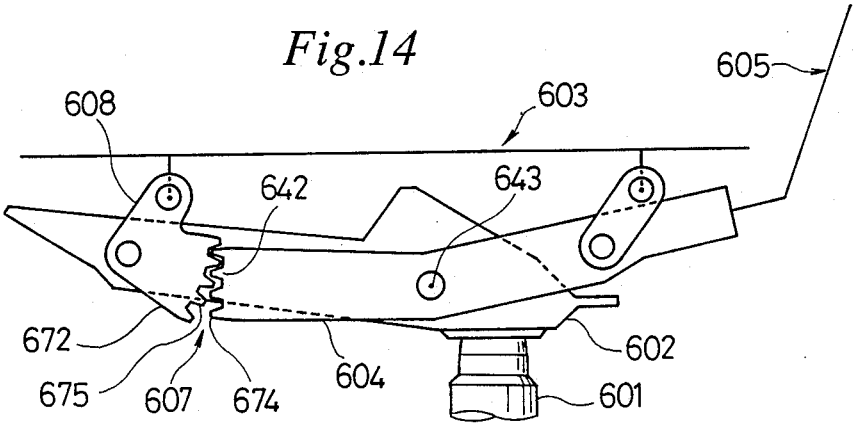

In the motion translating means 607 shown in FIG. 14 those teeth 674 and 675 which form part of a gear are formed on the front point of action 642 of the balancing member 604 and the forward end of the arm 672 of each front link member 608, respectively, and these teeth 674 and 675 mesh with each other. In FIG. 14, 601 is a leg, 602 is a support base, 603 is a seat, 605 is a backrest, and 643 is a fulcrum.

Besides the seat receiving means described above, those shown, for example, in FIGS. 15, 16 and 17 can be used.

Figure 15:
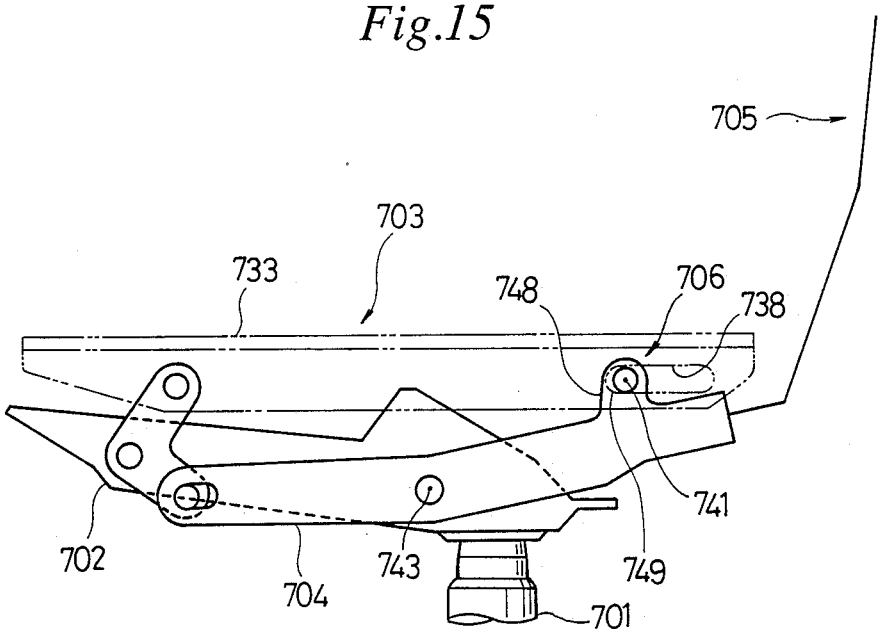
FIGS. 15, 16 and 17 are schematic side views of different embodiments, respectively, with different forms of the seat receiving means.

In the seat receiving means 706 shown in FIG. 15 a pair of projections 748 are provided on the rear point of action 741 of the balancing member 704, and a pin 749 projecting from each projection 748 slidably engages each slot 738 formed in the receiving frame 733 of the above-mentioned seat 703. In FIG. 15, 701 is a leg, 702 is a support base, 705 is a backrest, and 743 is a fulcrum.

Figure 16:
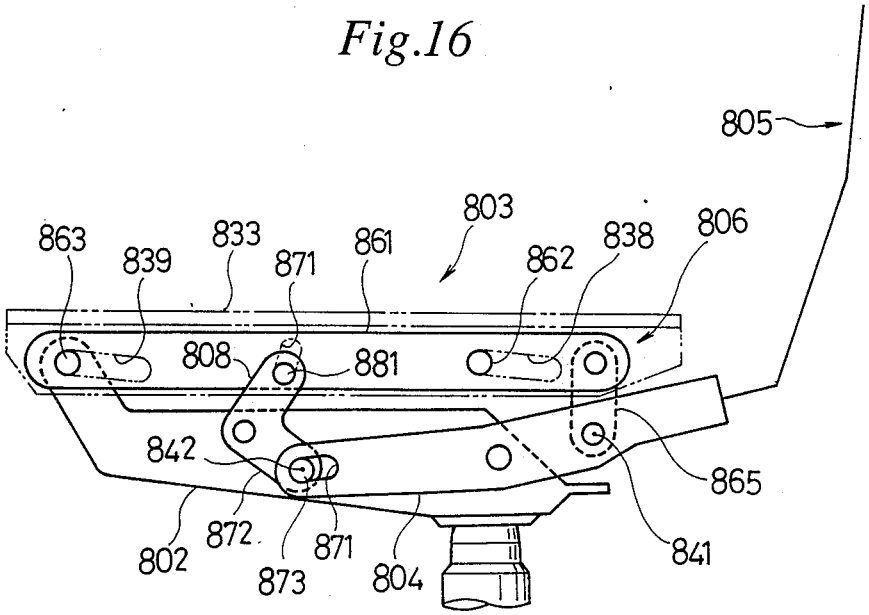

In the seat receiving means 806 shown in FIG. 16, a pivotable frame 861 is arranged below the receiving frame 833 of the seat 803 with the front end thereof pivotally supported on the support base 802, and the rear end of the pivotable frame 861 is supported on the rear point of action 841 of the balancing member 804 through each link member 865, with a pin 862 standing near the rear end of the frame 861 and slidably engaging each slot 838 formed in the above-mentioned receiving frame 833. In this embodiment, a pair of slots 839 is also provided near the front end of the above-mentioned receiving frame 833, and a pin 863 projecting from the front end of the above-mentioned support base 802 slidably engages each slot 839 thereby to support the front end of the seat 803 on the above-mentioned support base 802. A vertically extending, rearwardly inclined slot 871 is provided in each side plate of the above-mentioned receiving frame 833, and a pin 881 projecting from the upper end of each front link member 808 slidably engages the slot 871. A connecting pin 873 projects from the arm 872 of each front link member 808, and slidably engages each slot 871 formed at the front point of action 842 in the balancing member 804. With this arrangement, as the front point of action 842 of the balancing member 804 is shifted upwardly upon rearward inclination of the backrest 805, each front link member 808 is pivoted forwardly so as to shift the receiving frame 833 forwardly. When the receiving frame 833 advances forwardly, the frame 833 gradually rises by the pins 862, 863 guided by the slots 838, 839. However, since the above-mentioned pivotable frame 861 has its rear end connected to the rear point of action 841 of the balancing member 804, the rear pin 862 descends with forward movement of the receiving frame 833. Therefore, when the chair is observed as a whole, as the backrest 805 is inclined rearwardly and the seat 803 advances, the rear end of the seat 803 descends properly. The slots 838 and 839 may extend horizontally or slightly aslant forwardly.

Figure 17:
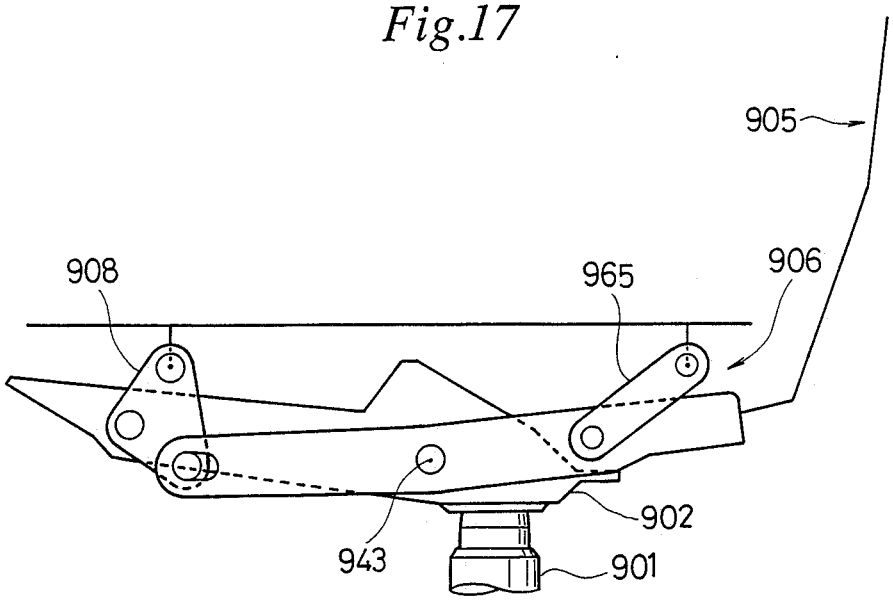

The seat receiving means 906 shown in FIG. 17 is provided with a pair of rear link members 965 of a different length from the front link members 908. In FIG. 17, 901 designates a leg, 902 designates a support base, 905 designates a backrest, and 943 designates a fulcrum.

Figure 18:
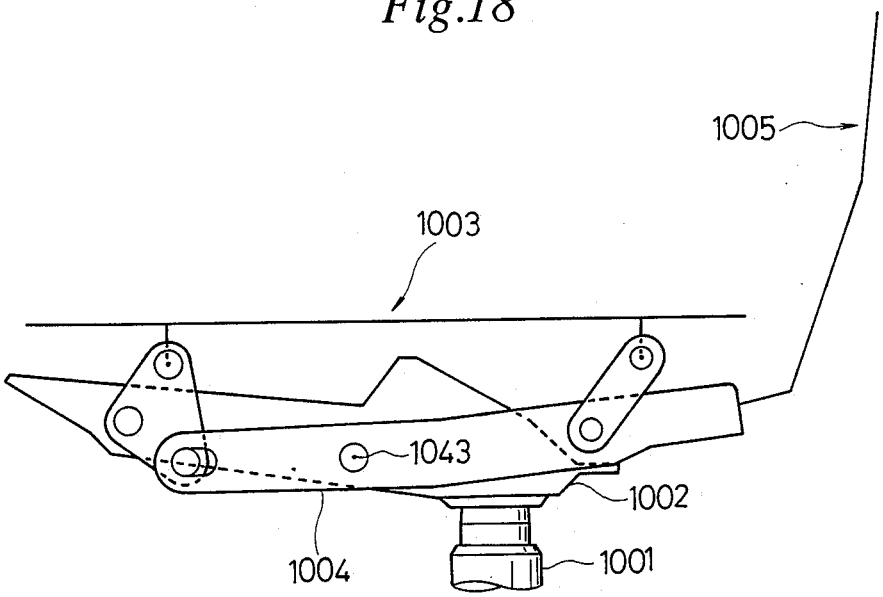
FIG. 18 is a schematic side view of another embodiment, wherein the balancing member is supported at a different position.

FIG. 18 shows another embodiment in which the fulcrum 1043 of the balancing member 1004 is set at a relatively forward position. In the drawing, 1001 is a support base, 1003 is a seat, 1005 is a backrest.

Figure 19:
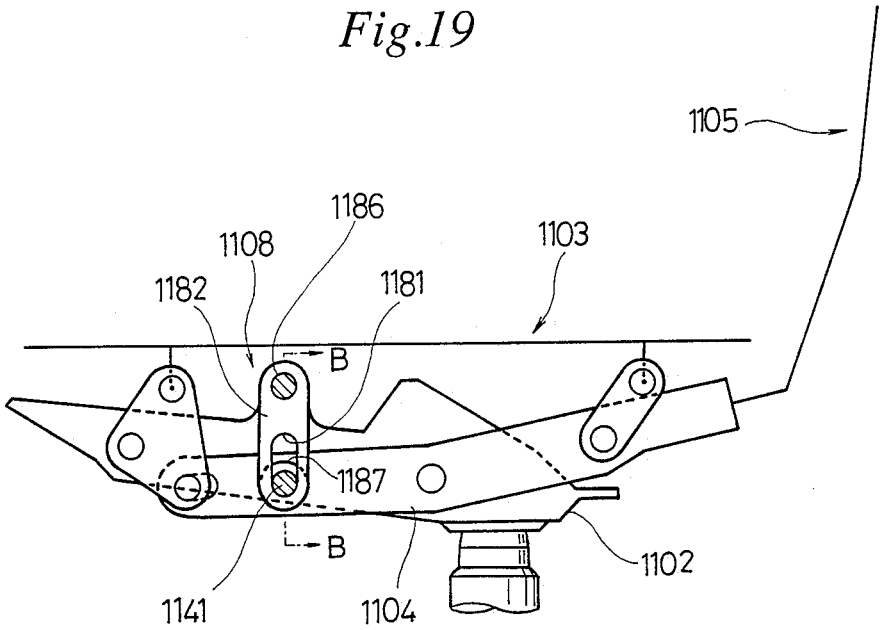
FIG. 19 is a schematic side view of another embodiment, with a locking mechanism added thereto.
Figure 20:
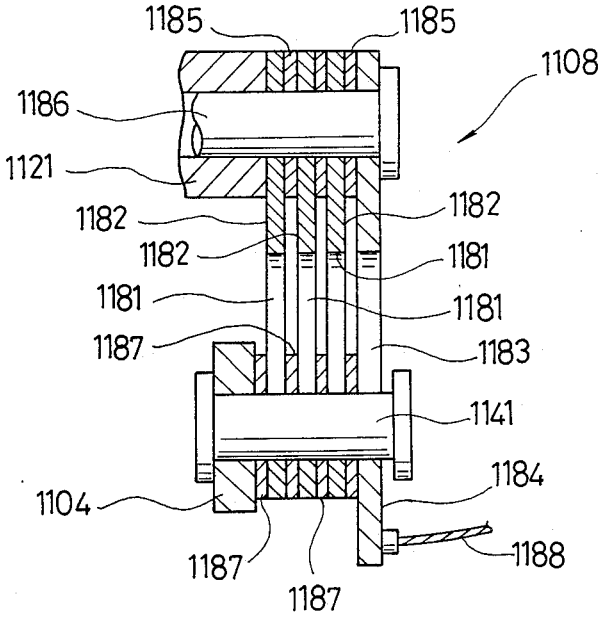
FIG. 20 is an enlarged sectional view taken alone line B—B in FIG. 19.

FIGS. 19 and 20 show an embodiment in which locking means 1108 is provided between the support base 1102 and the balancing member 1104. The locking means 1108 is constructed by alternately piling up a plurality of friction plates 1182 each having a vertically extending slot 1181 and a leaf spring 1184 having a vertically extending slot 1183 with a spacer 1185 interposed therebetween, and fastening the upper ends of these friction plates 1182, the upper end of the above-mentioned leaf spring 1184 and the above-mentioned spacers 1185 to the boss 1121 of the support base 1102 by means of a fastening shaft 1186. A pin 1141 provided on the balancing member 1104 slidably engages the above-mentioned slots 1181 and 1183, and a plurality of pad members 1187 mounted on the pin 1141 are interposed between the balancing member 1104 and the above-mentioned friction plates 1182, between adjacent two friction plates 1182, and between the friction plates 1182 and the leaf spring 1184. A wire 1183 is connected to the lower end of the leaf spring 1184 for pulling it outwardly. By handling an operating lever not shown but provided below the seat 1103 the wire 1183 can be pulled. With this arrangement, when no pulling force is exerted on the wire 1188, the resilient force of the leaf spring 1184 presses the pad members 1187, the friction plates 1182 and the leaf spring 1184 against each other. As a result, the movement of the balancing member 1104 is braked by the frictional force produced at the pressed areas between the members, so that the seat 1103 and the backrest 1105 are locked. When the wire 1188 is pulled by operating the control lever, the above-mentioned leaf spring 1184 is outwardly curved thereby to release the pressed condition of the pad members 1187 and the friction plates 1182. As a result, the balancing member 1104 can be pivoted, and the above-mentioned locked condition of the seat 1103 and the backrest 1105 is released.

Figure 21:
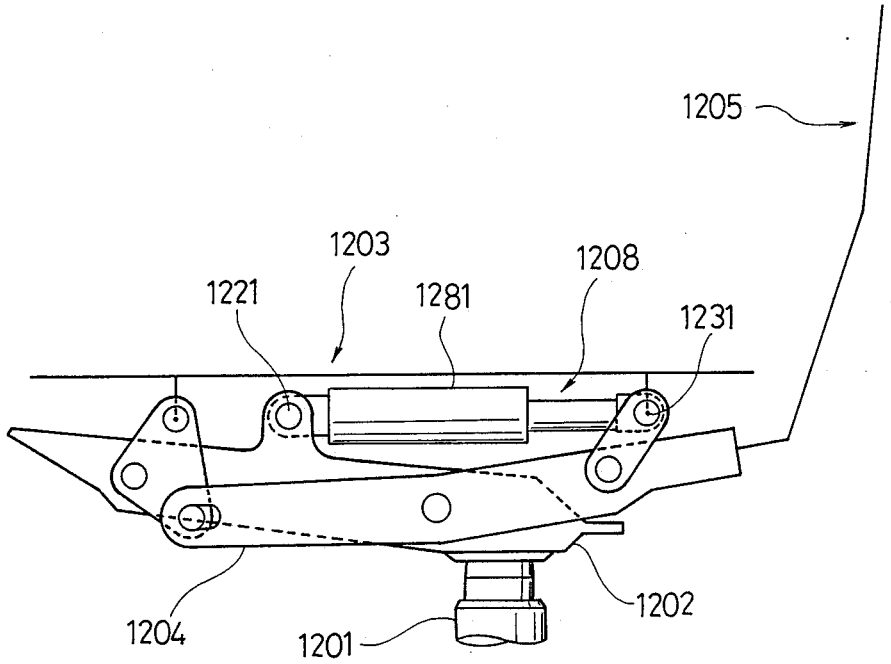
FIG. 21 is a schematic side view of another embodiment with a modified locking mechanism.

FIG. 21 shows another embodiment of the locking means. This locking means 1208 comprises a gas spring 1281 of a construction similar to the gas spring used for adjusting the length of the legs of a chair and interposed between the support base 1202 and the seat 1203. In particular, the gas spring 1281 which extends by the repelling force of a gas enclosed therein is provided between a cross member 1221 mounted on the above-mentioned support base 1202 and a shaft 1231 mounted on the rear end of the seat 1203. As is well known, the gas spring 1281 has built therein a valve mechanism for stopping flow of the interior fluid and locking the extension of the spring, it being possible to open and close the valve mechanism from outside. In this embodiment the valve mechanism can be controlled by a control lever not shown but provided below the seat 1203. In FIG. 21, 1201 is a leg, 1204 is a balancing member, and 1205 is a backrest. With this arrangement, if the valve mechanism of the gas spring 1281 is kept at a closed position thereby to prevent free extension or contraction of the gas spring 1281, the seat 1203 cannot freely move forwardly or rearwardly, so that inclination of the backrest 1205 is restricted. When the valve mechanism is opened by operating the control lever, the gas spring 1281 performs its spring function to resiliently urge the seat 1203 rearwardly. Then, when the user pushes the backrest 1205 rearwardly against the resilient force; the seat can be shifted to its rest position. Thus, the gas spring 1281 of this embodiment also functions as resiliently urging means.

Several embodiments of the invention having been described above, the invention is not limited thereto, but there may be various modifications without departing from the scope of the invention.

As mentioned above, the chair with a backrest constructed in accordance with the invention is suitable for use as a chair in a meeting room, for office work, or a chair an operator of an OA instrument uses. The invention can also be applied to a chair without a leg.

What is claimed is:

1. A chair which comprises:

a support base;

a seat which is movable forwardly and rearwardly, said seat comprising a front part and a rear part, wherein the front part is pivotably supported by the support base;

a balancing member positioned below the seat so as to extend longitudinally, said balancing member having a front portion, a rear portion, and a fulcrum set between the front portion and the rear portion so that said front portion is movable upwardly and downwardly, said balancing member being supported by said support base at the fulcrum;

a backrest provided on the rear portion of the balancing member;

seat receiving means for pivotally connecting the rear part of said seat to the rear portion of said balancing member; and motion translating means for operably connecting the front portion of said balancing member to the front part of said seat, said motion translating means translating an upward movement of said front portion of said balancing member to a forward movement of said seat.

2. The chair according to claim 1, wherein as said seat advances upon an upward movement of said front portion of said balancing member caused by a rearward inclination of said backrest, the rear part of said seat can descend relative to the front part of the seat.

3. The chair according to claim 1, further including resiliently urging means between the support base and the seat for resiliently urging said seat rearwardly.

4. The chair according to claim 1, wherein said seat receiving means includes means for pulling the seat rearwardly in reaction to a downward force on the seat exerted by a user of the chair.

5. The chair according to claim 4, wherein said seat receiving means is provided with link members each having a lower pivot end pivoted to said balancing member and an upper pivot end pivoted to said seat; and wherein at the reference position where said seat is maintained at its most retreated position, said upper pivot ends of each said link member is positioned rearwardly of said lower pivot end.

6. The chair according to claim 1, further including locking means connected to the support base and the balancing member for stopping the movement of said seat and said backrest at a desired position.

7. The chair according to claim 1, wherein the front part of the seat is supported on the support base by front link members each having a lower pivot end pivoted to said support base and an upper pivot end pivoted to said front part of the seat, and wherein at the reference position where said seat is maintained at its most retreated position, said upper pivot end of each said link member is positioned rearwardly of said lower pivot end.

8. The chair according to claim 7, wherein the motion translating means comprises a slot formed in the front portion of the balancing member and extending lengthwise, an arm integral with the front link member, and a connecting pin projecting from said arm so as to slidingly engage said slot.

9. The chair according to claim 7, wherein the motion translating means comprises a pin fixed to the front portion of the balancing member, and an arm integral with the front link member, said pin being in sliding contact with the lower edge of said arm.

10. The chair according to claim 7, wherein the motion translating means comprises teeth in the front portion of the balancing member, and teeth in an arm integral with the front link member, such that the teeth in the balancing member and the teeth in the arm mesh with each other.

11. The chair according to claim 1, wherein the seat receiving means comprises a lengthwise slot in the seat, a projection arm on the rear portion of the balancing member, and a pin extending from said projection arm, wherein said pin slidably engages said slot.

12. The chair according to claim 1, wherein the balancing member comprises a pair of parallel plates extending longitudinally and a connecting plate integrally connecting the rear portions of said parallel plates.

* * * * *